US010233792B2

(12) United States Patent
Whiston et al.

(10) Patent No.: US 10,233,792 B2
(45) Date of Patent: Mar. 19, 2019

(54) ARRANGEMENT FOR REDUCING TORSIONAL LOADING OF A CAMSHAFT

(71) Applicant: Ford Global Technologies, LLC, Dearborn, MI (US)

(72) Inventors: Phil John Whiston, Ingatestone (GB); Neil Haynes, Benfleet (GB); Richard Dukes, Leamington Spa (GB)

(73) Assignee: Ford Global Technologies, LLC, Dearborn, MI (US)

( * ) Notice: Subject to any disclaimer, the term of this patent is extended or adjusted under 35 U.S.C. 154(b) by 20 days.

(21) Appl. No.: 15/162,266

(22) Filed: May 23, 2016

(65) Prior Publication Data

US 2016/0356185 A1 Dec. 8, 2016

(30) Foreign Application Priority Data

Jun. 5, 2015 (GB) ..... 1509768.6

(51) Int. Cl.

| | |
|---|---|
| ***F02B 63/00*** | (2006.01) |
| ***F01L 1/46*** | (2006.01) |
| ***F01L 1/053*** | (2006.01) |

(52) U.S. Cl.

CPC ..... *F01L 1/46* (2013.01); *F01L 1/0532* (2013.01); *F01L 2250/02* (2013.01); *F01L 2250/04* (2013.01); *F01L 2810/03* (2013.01)

(58) Field of Classification Search

CPC ..... F01L 1/3442; F01M 39/02; F01M 37/06

(Continued)

(56) References Cited

U.S. PATENT DOCUMENTS 5,271,366 A * 12/1993 Shimada ..... F02D 41/403 123/300
5,603,303 A * 2/1997 Okajima ..... F01L 1/053 123/508

(Continued)

FOREIGN PATENT DOCUMENTS

DE 10311443 A1 9/2004
EP 0849438 A1 12/1997

(Continued)

OTHER PUBLICATIONS

Examination Report of Great Britain Patent Application No. 1509768.6, dated Nov. 18, 2015, 8 pages, United Kingdom Intellectual Property Office.

*Primary Examiner* — Marguerite McMahon
*Assistant Examiner* — James Kim
(74) *Attorney, Agent, or Firm* — Julia Voutyras; McCoy Russell LLP

(57) ABSTRACT

An engine comprising a camshaft, the engine coupleable to an auxiliary device driven from the camshaft, the camshaft comprising: a plurality of valve cams each configured to actuate a respective intake valve or exhaust valve of the engine, an angular orientation of the valve cams about the rotational axis of the camshaft defined by the operational requirements of the valves; and an auxiliary device cam configured to actuate a drive element of the auxiliary device via one or more cam lobes, the auxiliary device cam having an angular orientation about the rotational axis of the camshaft, and the drive element having an angular orientation about the rotational axis of the camshaft, wherein the angular orientation of the drive element of the auxiliary device is selected respective to the angular orientation of the valve cams such that each actuation event of the auxiliary (Continued)

device occurs between two successive valve actuation events.

20 Claims, 8 Drawing Sheets

(58) Field of Classification Search
USPC ..... 123/2, 196 R, 446, 456, 495, 508, 90.17
See application file for complete search history.

(56) References Cited

U.S. PATENT DOCUMENTS 5,899,181 A * 5/1999 Kurata ..... F01L 1/024 123/508
6,082,336 A 7/2000 Takahashi et al.
6,148,787 A * 11/2000 Takano ..... F01L 1/0532 123/195 A
6,321,711 B1 11/2001 Kato
6,758,184 B1 * 7/2004 Lee ..... F01M 1/02 123/196 R
6,763,808 B2 7/2004 Ryuzaki
6,868,835 B2 3/2005 Tsubouchi
7,568,456 B2 * 8/2009 Kusaka ..... F01L 9/04 123/90.15
7,861,682 B2 1/2011 Berger
9,435,328 B2 * 9/2016 Gerlach ..... F02M 59/30
2004/0247471 A1 * 12/2004 Lee ..... F01M 1/02 417/470
2007/0193541 A1 8/2007 Imamura
2009/0107434 A1 * 4/2009 Berger ..... F01L 1/047 123/90.31
2011/0100319 A1 * 5/2011 Shin ..... F02M 39/02 123/196 R
2013/0000604 A1 * 1/2013 Gerstner ..... F02M 63/027 123/456
2014/0251283 A1 * 9/2014 Bauman ..... F16H 53/06 123/495
2015/0068505 A1 * 3/2015 Iwase ..... F02D 41/008 123/673

FOREIGN PATENT DOCUMENTS

JP H0842309 A 2/1996
JP 2001227425 A 8/2001

* cited by examiner

ARRANGEMENT FOR REDUCING TORSIONAL LOADING OF A CAMSHAFT

CROSS-REFERENCE TO RELATED APPLICATION

This application claims priority to Great Britain Patent Application No. 1509768.6, entitled "Arrangement for Reducing Torsional Loading of a Camshaft," filed on Jun. 5, 2015, the entire contents of which are hereby incorporated by reference for all purposes.

FIELD

This disclosure relates to an engine comprising a camshaft having a plurality of cams configured to actuate one or more valves of the engine and an auxiliary device of the engine, and in particular, but not exclusively, to an engine having a camshaft, wherein the angular orientation of the cams of the camshaft and/or the angular orientation of the auxiliary device with respect to the cams of the camshaft are individually selected to reduce fluctuations in the torsional loading of the camshaft.

INTRODUCTION

A modern internal combustion engine has one or more camshafts that are coupled to a primary drive of the engine, for example a belt/chain drive rotationally coupled to a crankshaft of the engine. The engine may have intake valves and exhaust valves that are driven by separate camshafts, which means that the primary drive is configured to transmit a driving torque from the crankshaft to a plurality of camshafts.

The intake and the exhaust valves are typically actuated by virtue of valve cams on the intake and exhaust camshafts. During the actuation of each intake and exhaust valve by the valve cams, a resistive torque is transmitted to the primary drive, causing a fluctuation in the tension of the belt/chain of the primary drive.

The camshafts may also be configured to drive one or more auxiliary devices of the engine by virtue of one or more auxiliary cam lobes, for example the camshafts may be configured to drive a fuel pump of a fuel injection system. In a similar manner to the valve cams, during the actuation of the auxiliary device by the auxiliary cam lobes, another restive torque is transmitted to the primary drive.

The primary drive must therefore be configured to account for fluctuations in the tension in the drive belt/chain. With ever-increasing requirements to maximise power output and fuel economy, it is desirable to minimise fluctuations in the resistive torque transmitted to the primary drive and/or any other device coupled to the camshaft.

STATEMENTS OF INVENTION

According to an aspect of the present disclosure there is provided an engine comprising a camshaft. The engine is coupleable to an auxiliary device that is driven from the camshaft. The auxiliary device may be a fuel pump, for example a fuel injector pump or a fuel lift pump, a vacuum pump, a hydraulic pump, or any appropriate accessory device of the engine. The camshaft comprises a plurality of valve cams each configured to actuate a respective intake valve or exhaust valve of the engine. The angular orientation of the valve cams about the rotational axis of the camshaft is defined by the operational requirements of the valves. The camshaft comprises an auxiliary device cam configured to actuate a drive element of the auxiliary device, for example by virtue of one or more cam lobes. The auxiliary device cam has an angular orientation about the rotational axis of the camshaft. The drive element has an angular orientation about the rotational axis of the camshaft when the auxiliary device is coupled to the engine. The angular orientation of auxiliary device cam is selected with respect to the angular orientation of the valve cams such that each actuation event of the auxiliary device occurs in between two successive valve actuation events. The angular orientation of the drive element of the auxiliary device is selected with respect to the angular orientation of the valve cams such that each actuation event of the auxiliary device occurs in between two successive valve actuation events. A valve actuation event may be the time at which peak displacement of the valve occurs. An auxiliary device actuation event may be the time at which peak displacement of the auxiliary device occurs.

Each of the valve cams may be a single-lobed cam. The auxiliary device cam may be a multi-lobed cam.

Each valve cam may provide a first periodic resistive torque to the rotation of the camshaft as the valve cam actuates the valve. A peak value in the first periodic resistive torque may occur at maximum valve displacement. The auxiliary device cam may provide a second periodic resistive torque to the rotation of the camshaft as the auxiliary device cam actuates the auxiliary device. A peak value in the second periodic resistive torque may occur at maximum fuel pump displacement. The angular orientation of auxiliary device cam with respect to the angular orientation of the valve cams may be selected such that a peak value of the second periodic resistive torque occurs in between two successive peak values of the first periodic resistive torque. The angular orientation of an operational axis of the fuel pump with respect to the angular orientation of the valve cams may be selected such that a peak value of the second periodic resistive torque occurs in between two successive peak values of the first periodic resistive torque.

The first and second periodic resistive torques may define an oscillation in the resistive torque provided to a primary drive of the engine during operation of the engine. The angular orientation of auxiliary device cam with respect to the angular orientation of the valve cams may be selected to reduce an amplitude of the oscillation in resistive torque provided to the primary drive. The angular orientation of the operational axis of the fuel pump with respect to the angular orientation of the valve cams may be selected to reduce an amplitude of the oscillation in resistive torque provided to the primary drive. The amplitude may be a peak amplitude. The amplitude may be a peak-to-peak amplitude. The amplitude may be a root mean square amplitude.

The angular orientation of auxiliary device cam with respect to the angular orientation of the valve cams may be selected to minimise the magnitude between the maxima and the minima of the oscillation in resistive torque. The angular orientation of the operational axis of the fuel pump with respect to the angular orientation of the valve cams may be selected to minimise the magnitude between the maxima and the minima of the oscillation in resistive torque. The engine may be configured such that the operational axis of a fuel pump of the engine extends radially from the rotational axis of the camshaft when the camshaft and the fuel pump are in an installed configuration.

The shape of each valve cam lobe may be independently selected to reduce the amplitude of the oscillation in resistive torque. The valve cam may be rotationally symmetric. The valve cam may be rotationally asymmetric. The angular orientation of each valve cam with respect to at least one other valve cam may be independently selected to reduce the amplitude of the oscillation in resistive torque.

The shape of each lobe of the auxiliary device cam may be independently selected to reduce the amplitude of the oscillation in resistive torque. The auxiliary device cam may be rotationally symmetric. The auxiliary device cam may be rotationally asymmetric. The angular orientation of a lobe of the auxiliary device cam with respect to at least one other lobe of the auxiliary device cam may be independently selected to reduce the amplitude of the oscillation in resistive torque.

The camshaft may be configured to actuate the valves of a plurality of cylinders of the engine. The number of lobes of the auxiliary device cam may be equal to the number of cylinders of the engine.

Each of the valve cams may be rigidly fixed to the camshaft. Each of the auxiliary device cams may be rigidly fixed to the camshaft. Each of the valve cams may be movable with respect to the camshaft. The auxiliary device cam may be movable with respect to the camshaft. The engine may comprise a selective cylinder deactivation system configured to at least partially deactivate one or more cylinders of the engine. The engine may comprise the fuel pump.

According to another aspect of the present disclosure, there is provided an engine comprising a camshaft. The engine is coupleable to an auxiliary device that is driven from the camshaft. The camshaft comprises a plurality of valve cams each configured to actuate a respective intake valve or exhaust valve of the engine. The angular orientation of the valve cams about the rotational axis of the camshaft is defined by the operational requirements of the valves. The camshaft comprises an auxiliary device cam configured to actuate a drive element of the auxiliary device, for example by virtue of one or more cam lobes. The auxiliary device cam has an angular orientation about the rotational axis of the camshaft. The drive element has an angular orientation about the rotational axis of the camshaft when the auxiliary device is coupled to the engine. The angular orientation of auxiliary device cam and the angular orientation of the drive element of the auxiliary device are selected with respect to the angular orientation of the valve cams such that each actuation event of the auxiliary device occurs in between two successive valve actuation events.

According to a further aspect of the present disclosure, there is provided an engine comprising a camshaft, an engine valve that is driven from the camshaft and an auxiliary device that is driven from the camshaft. The camshaft comprises a valve cam configured to actuate the engine valve. The angular orientation of the valve cam about the rotational axis of the camshaft is determined by the operational requirements of the engine valve, such as the timing and duration of opening of the engine valve. The camshaft comprises an auxiliary device cam configured to actuate a drive element of the auxiliary device, such as a plunger of the auxiliary device, which may contact the auxiliary device cam directly. At least one of the angular orientation of the auxiliary device cam and the angular orientation of the drive element of the auxiliary device is selected with respect to the angular orientation of the valve cam such that the fluctuation in the sum of resistive torques which are applied by the valve cam and the auxiliary device cam to the camshaft is minimized.

According to a further aspect of the present disclosure, there is provided a method of manufacturing an engine comprising a camshaft, an engine inlet valve or exhaust valve and an auxiliary device, such as a fuel pump. The method comprises configuring a valve cam of the camshaft such that an angular orientation of the valve cam about the rotational axis of the camshaft is determined by the operational requirements of the engine valve, such as the required timing and duration of opening of the engine valve. The method comprises configuring an auxiliary device cam to actuate a drive element of the auxiliary device, such as a plunger or cam follower of the auxiliary device. The method comprises selecting at least one of the angular orientation of the auxiliary device cam and the angular orientation of the drive element of the auxiliary device with respect to the angular orientation of the valve cam, such that the fluctuation in the sum of resistive torques which are applied by the valve cam and the auxiliary device cam to the camshaft is minimized.

To avoid unnecessary duplication of effort and repetition of text in the specification, certain features are described in relation to only one or several aspects or embodiments of the disclosure. However, it is to be understood that, where it is technically possible, features described in relation to any aspect or embodiment of the invention may also be used with any other aspect or embodiment of the disclosure.

BRIEF DESCRIPTION OF THE DRAWINGS

For a better understanding of the present disclosure, and to show more clearly how it may be carried into effect, reference will now be made, by way of example, to the accompanying drawings, in which.

DETAILED DESCRIPTION

FIGS. 1-2 and 4-6 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. The vertical axis is a direction opposite, relative to gravity. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. An element shown within another element or shown outside of another element may be referred as such, in one example. Further still, when referring to angles, rotation in a clockwise direction is denoted by a positive angle, and a rotation in an anticlockwise direction is denoted by a negative angle.

Figure 1:
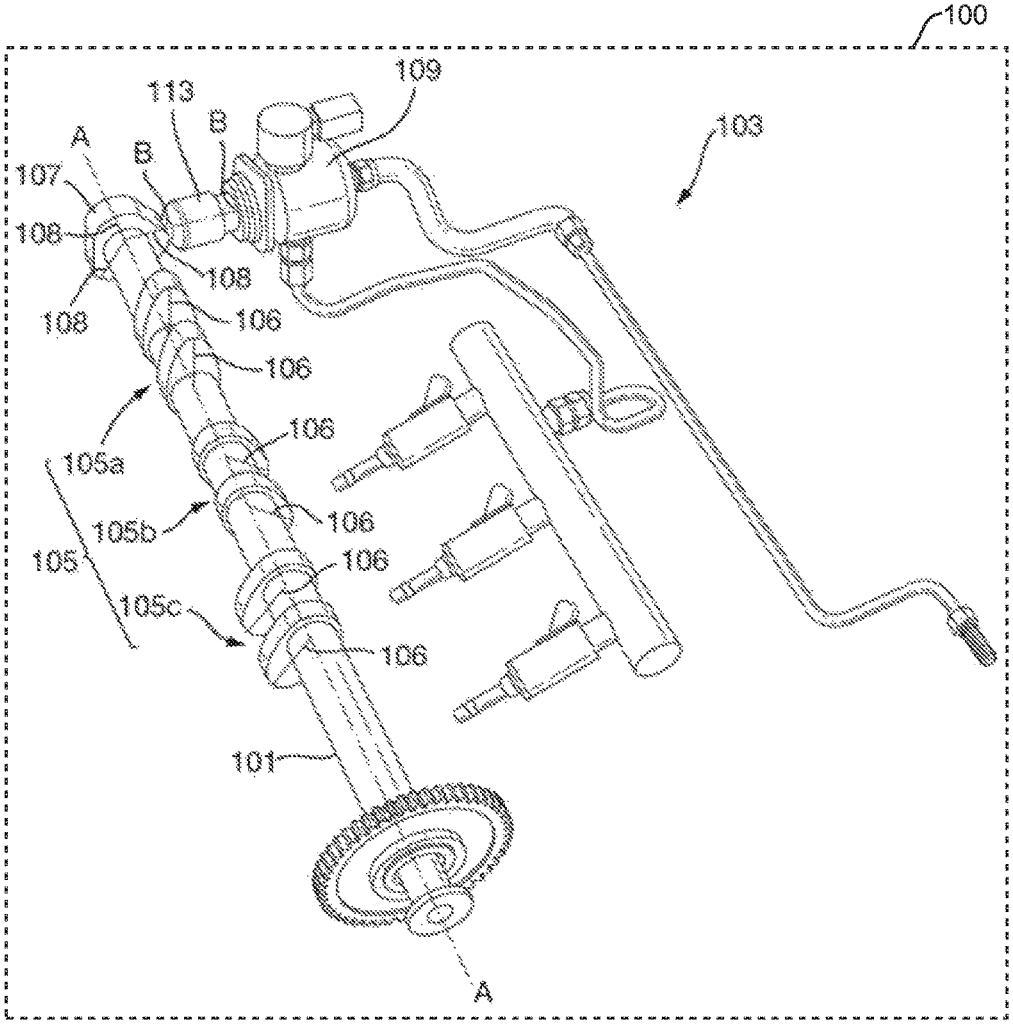
FIG. 1 shows a perspective view of a camshaft and a fuel injection system for an engine.

FIG. 1 shows a perspective view of a camshaft 101 and a fuel injection system 103 for an engine 100. In the arrangement shown in FIG. 1, the camshaft 101 is an intake camshaft that is configured to actuate a plurality of intake valves of the engine 100, which may for example be a double overhead camshaft (DOHC) engine. The engine 100 according to the present disclosure may however be any appropriate type of engine, for example an overhead valve (OHV) engine or a single overhead camshaft engine (SOHC).

In the context of the present disclosure, the terms "intake valve" and "exhaust valve" refer to valves that are used to control the timing and quantity of gas and/or vapour flow from an intake manifold into a cylinder and out of the cylinder of the engine into an exhaust manifold respectively. For the sake of brevity, the below description will focus on the operation of the intake camshaft 101 shown in FIG. 1. It is to be understood, however, that the described implementation and operation of the present disclosure applies equally to an exhaust camshaft, or indeed any camshaft of an engine.

In the arrangement shown in FIG. 1, the engine 100 is a three cylinder engine. However, in another arrangement, the engine may comprise any appropriate number of cylinders, for example the engine 100 may be a four cylinder engine, a six cylinder engine, and so on.

The camshaft 101 comprises three pairs of valve cams 105*a*, 105*b*, 105*c*, each pair of valve cams 105*a*, 105*b*, 105*c*, being configured to actuate a pair of intake valves of respective cylinders of the engine. Each of the valve cams 105 has a single lobe configured to actuate a respective valve of the engine 100. However, in another arrangement, the valve cams 105 may each comprise any appropriate number of lobes.

An angular orientation of each of the valve cams 105 about a rotational axis A-A of the camshaft 101 is defined by respective operational requirements of each valve of the engine. For the example of a DOHC engine, the valves may be driven directly by the valve cams 105, and as a result, an operational axis of the valves may be coaxial with a lobe centreline 106 of the valve cams 105, i.e. a line that extends from the centre of rotation to the nose of the valve cam 105, when the valve reaches its peak displacement. However, in another DOHC engine configuration, or for example a SOHC configuration, the valves may be operatively coupled to the valve cams 105 by virtue of one or more linkage mechanisms, for example a rocker mechanism. As a result, the operational axis of the valves may be inclined to and/or offset from the lobe centreline 106 of the valve cams 105 when the valve reaches its peak displacement.

The angular orientation of each valve cam 105 about the rotational axis A-A of the camshaft 101 is selected depending on the operational requirements of the respective valve which the valve cam 105 actuates. For example, the angular orientation of the valve cams 105 may be selected depending on the desired timing of respective valves. For the arrangements shown in FIGS. 1-2 and 4-6, an operational axis C-C of each valve 111 is inclined by 120° from a vertical 112, and the angular orientation of each of the valve cams 105 selected such that the lobe centreline 106 of the respective valve cams 105 is aligned with the operational axis C-C of each valve 111 when the valve 111 reaches its peak displacement. Such an arrangement is only shown by way of example of the present disclosure. The operational axis C-C of the valve 111 of the engine may be orientated at any appropriate angle with respect to the angular orientation of the valve cams 105 about the rotational axis A-A of the camshaft 101.

The camshaft 101 comprises an auxiliary device cam, for example a fuel pump cam 107, configured to actuate the drive element 113 of the fuel pump 109, for example by virtue of one or more lobes of the fuel pump cam 107. In the arrangement shown in FIG. 1, the fuel pump 109 is a high pressure fuel pump of the fuel injection system 103. The auxiliary device may, however, be any appropriate type of auxiliary device of an engine.

Each lobe of the fuel pump cam 109 has a lobe centreline 108 that extends from the centre of rotation to the nose of each lobe of the fuel pump cam 107. In the arrangement shown in FIG. 1, the fuel pump cam 107 comprises three lobes such that the fuel pump is actuated three times per revolution of the camshaft 101. The fuel pump cam 107 may, however, have any appropriate number of lobes depending on the operational requirements of the fuel injection system 103.

The camshaft 101 is configured such that the lobe centrelines 108 of the fuel pump cam 107 extend radially from the rotational axis A-A of the camshaft 101. In the arrangement shown in FIG. 1, the fuel pump 109 is driven directly by the fuel pump cam 107, and as a result, when the fuel pump 109 reaches its peak displacement, one of the lobe centrelines 108 of the fuel pump cam 107 is coaxial with operational axis B-B of the fuel pump drive element 113 and the operational axis of the fuel pump 109. In this manner, the operational axis of the fuel pump 109 may also extend radially from the rotational axis A-A of the camshaft 101 as shown in FIG. 1. However, in a different arrangement, the fuel pump drive element 113 may be operatively coupled to the fuel pump 109 by virtue of one or more linkage mechanisms, for example a rocker mechanism. As a result, the operational axis of the fuel pump 109 may be inclined to, offset from and/or remote from the operational axis B-B of the fuel pump drive element 113.

In a similar manner to the angular orientation of the valve cams 105, the angular orientation $\theta_{FPCAM}$ of the fuel pump cam 107 may be selected depending on the operational requirements of the fuel pump 109.

Figure 2:
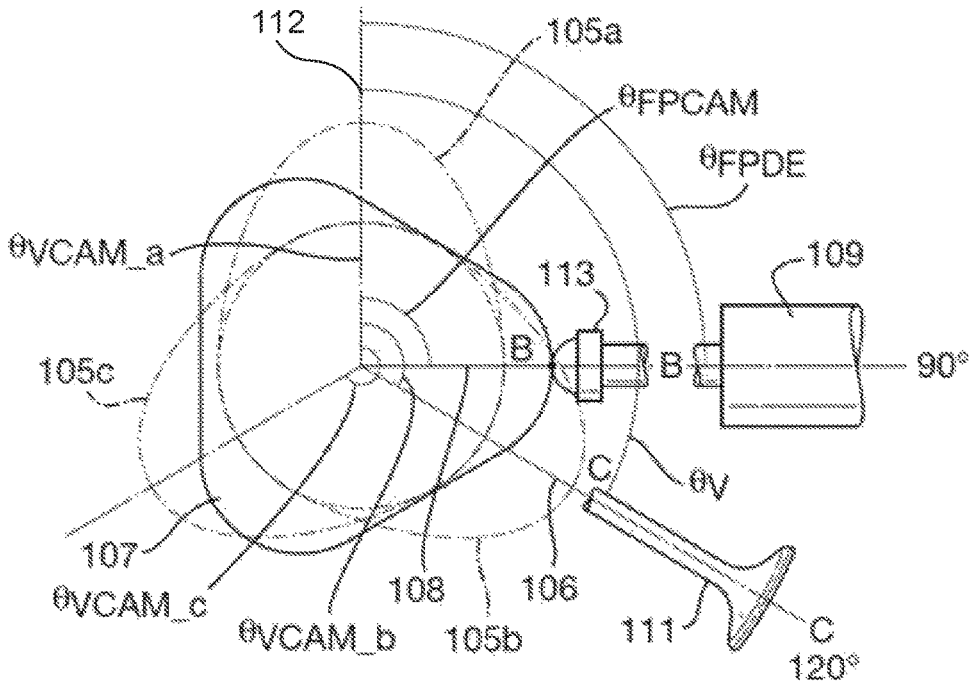
FIG. 2 shows an end view of the camshaft shown in FIG. 1 in relation to a valve of the engine and a fuel pump of the fuel injection system.

FIG. 2 shows an end view of the camshaft 101 shown in FIG. 1. FIG. 2 shows the angular orientation $\theta_{VCAM_a}$, $\theta_{VCAM_b}$, $\theta_{VCAM_c}$ of respective valve cam pairs 105*a*, 105*b*, 105*c* about the rotational axis A-A of the camshaft 101. When referring to values for angles, the values are measured relative to a vertical 112. Further, the values of angles are denoted by a positive angle when describing rotation in a clockwise direction, and the angles are denoted by a negative angle when describing rotation in an anticlockwise direction. FIG. 2 also shows the angular orientation $\theta_V$ of the operational axis C-C of the valve 111 of the engine with respect to the angular orientation $\theta_{VCAM_a}$, $\theta_{VCAM_b}$, $\theta_{VCAM_c}$ of each of the valve cams valve cam pairs 105*a*, 105*b*, 105*c*, when the camshaft 101 is in an installed configuration in the engine. FIG. 2 also shows and the angular orientation $\theta_{FPCAM}$ of the fuel pump cam 107 and the angular orientation $\theta_{FPDE}$ of the operational axis B-B of the fuel pump drive element 113 in relation to the angular orientation $\theta_{VCAM_a}$, $\theta_{VCAM_b}$, $\theta_{VCAM_c}$ of respective valve cam pairs 105*a*, 105*b*, 105*c*, when the camshaft 101 and the fuel pump 109 are in an installed configuration in the engine. In the arrangement shown in FIGS. 1 to 6, the valve cam pairs 105*a*, 105*b*, 105*c* are equi-angularly spaced around the rotational axis A-A of the camshaft 101. In the context of the present disclosure, with reference to the camshaft 101 shown in FIGS. 1 to 6, rotation in a clockwise direction is denoted by a positive angle, for example $\theta_{CAM}$, and a rotation in an anticlockwise direction is denoted by a negative angle, for example $-\theta_{CAM}$.

In the arrangement shown in FIG. 2, the operational axis C-C of the valve 111 is inclined at 120° from the vertical 112 in an installed configuration, and the operational axis B-B of the fuel pump drive element 113 is orientated at 90° from the vertical 112. The first valve cam pair 105*a* is arranged at 0°, the second valve cam pair 105*b* is arranged at 120° (i.e. in line with the operational axis C-C of the valve 111), and the third valve cam pair 105*c* is arranged at 240°. The fuel pump cam 107 is arranged such that one of the lobe centrelines 108 of the fuel pump cam 107 is at 90° (i.e. in line with the operational axis B-B of the fuel pump drive element 113). In this manner, the angular orientation $\theta_{VCAM_a}$, $\theta_{VCAM_b}$, $\theta_{VCAM_c}$ of respective valve cam pairs 105*a*, 105*b*, 105*c* and the angular orientation $\theta_{FPCAM}$ of the fuel pump cam 107 about the rotational axis A-A of the camshaft 101 is such that each fuel pump actuation event, which is caused by each of the fuel pump lobes, occurs at the same time as each valve actuation event, which is caused by one of the valve cam pairs 105*a*, 105*b*, 105*c*

In the context of the present disclosure, the term "actuation event" is interpreted as the time at which peak displacement of the valve 111 or the fuel pump occurs. In this manner, the fuel pump cam 107 is orientated about the rotational axis A-A of the camshaft 101 such that the peak displacement of the fuel pump 109 occurs at the same time as the peak displacement of the valve 111. It is understood, however, that actuation of a valve may occur over a time period, for example as a cam follower follows the profile of the cam lobe. In one arrangement, whilst the start and/or end points of the actuation of the valve 111 may not be timed to occur with the start and/or end points of the actuation of the fuel pump 109, the peak displacement of the valve 111 may still occur at the same time as the peak displacement of the fuel pump 109.

During operation of the engine, the valve cams 105 provide a first periodic resistive torque $T_V$ to the rotation of the camshaft 101 as the valve cams 105 actuate the valve 111. In a similar manner, the fuel pump cam 107 provides a second periodic resistive torque $T_{FP}$ to the rotation of the camshaft 101 as each lobe of the fuel pump cam 107 actuates the fuel pump 109.

Figure 3:
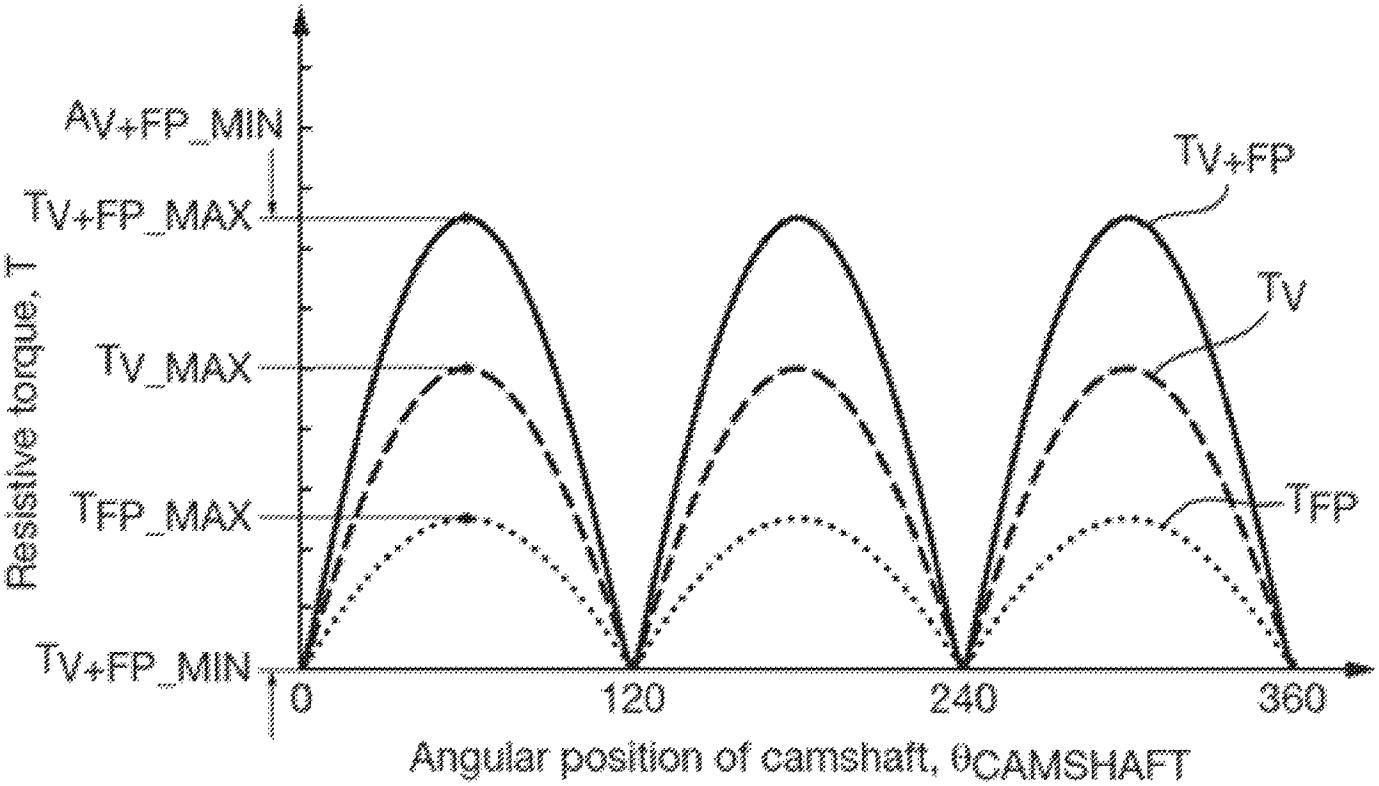
FIG. 3 shows a graphical representation of the relationship between the angular orientation of the camshaft and the resistive torques applied to the camshaft for the arrangement shown in FIG. 2.

FIG. 3 shows a graphical representation of the first and second resistive torques $T_V$, $T_{FP}$ applied to the camshaft 101 with respect to the angular position of the camshaft $\theta_{CAMSHAFT}$. In FIG. 3, the dashed line represents the first periodic resistive torque $T_V$ applied to the rotation of the camshaft as the valve cam 105 actuates the valve 111, and the dotted line represents the second period resistive torque $T_{FP}$ applied to the rotation of the camshaft 101 as each lobe of the fuel pump cam 107 actuates the fuel pump 109.

FIG. 3 illustrates that the combined resistive torque $T_{v+FP}$ applied to the rotation of the camshaft 101 is a function of the first and second resistive torques $T_V$, $T_{FP}$. The first and second periodic resistive torques $T_V$, $T_{FP}$ define an oscillation in the resistive torque $T_{V+FP}$ provided to a primary drive of the engine during operation of the engine. The solid line of FIG. 3 represents the combined resistive torque $T_{V+FP}$ applied to the rotation of the camshaft 101 as a result of the first and second resistive torques $T_V$, $T_{FP}$ provided by the valve cams 105 and the fuel pump cam 107 respectively. The amplitude $A_{V+FP}$ of the oscillation of the resistive torque $T_{V+FP}$ is defined by the difference between the maxima $T_{V+FP_MAX}$ and the minima $T_{V+FP_MIN}$ of the oscillation in the resistive torque $T_{V+FP}$. It is desirable, therefore, to reduce the amplitude $A_{V+FP}$ of the oscillation in the resistive torque $T_{V+FP}$ which is applied to the primary drive of the engine during operation of the engine. For example, by reducing the amplitude $A_{V+FP}$ of the oscillation in the resistive torque $T_{V+FP}$, fluctuations in the in primary drive belt/chain tension may be reduced. As a result, lower primary drive belt/chain pre-tension may be used, for example a primary drive tensioning device may be set to provide a lower belt pre-tension, which reduces friction in the primary drive of the engine, thereby increasing engine efficiency.

The present disclosure provides one or more arrangements of an engine comprising the camshaft 101 wherein the angular orientation $\theta_{FPCAM}$ of the fuel pump cam 107 of the camshaft 101 and/or the angular orientation $\theta_{FPDE}$ of the operational axis B-B of the fuel pump drive element 113 with respect to the angular orientation $\theta_{VCAM_a}$, $\theta_{VCAM_b}$, $\theta_{VCAM_c}$ of the pairs valve cams 105*a*, 105, 105*c* are selected such each actuation event of the fuel pump 109 occurs in between two successive valve actuation events. For example the angular orientation $\theta_{FPCAM}$ of the fuel pump cam 107 with respect to the angular orientation $\theta_{VCAM_a}$, $\theta_{VCAM_b}$, $\theta_{VCAM_c}$ of the pairs of valve cams 105*a*, 105*b*, 105*c* may be selected such that peak value $T_{FP_MAX}$ of the second periodic resistive torque $T_{FP}$ occurs in between two successive peak $T_{V_MAX}$ values of the first resistive torque $T_V$. Additionally or alternatively, the angular orientation $\theta_{FPDE}$ of the operational axis B-B of the fuel pump drive element 113 with respect to the angular orientation $\theta_{VCAM_a}$, $\theta_{VCAM_b}$, $\theta_{VCAM_c}$ of the pairs of valve cams 105*a*, 105*b*, 105*c* may be selected such that the peak value $T_{FP_MAX}$ of the second period resistive torque occurs in between two successive peak values $T_{V_MAX}$ of the first periodic resistive torque $T_{FP}$.

Figure 4:
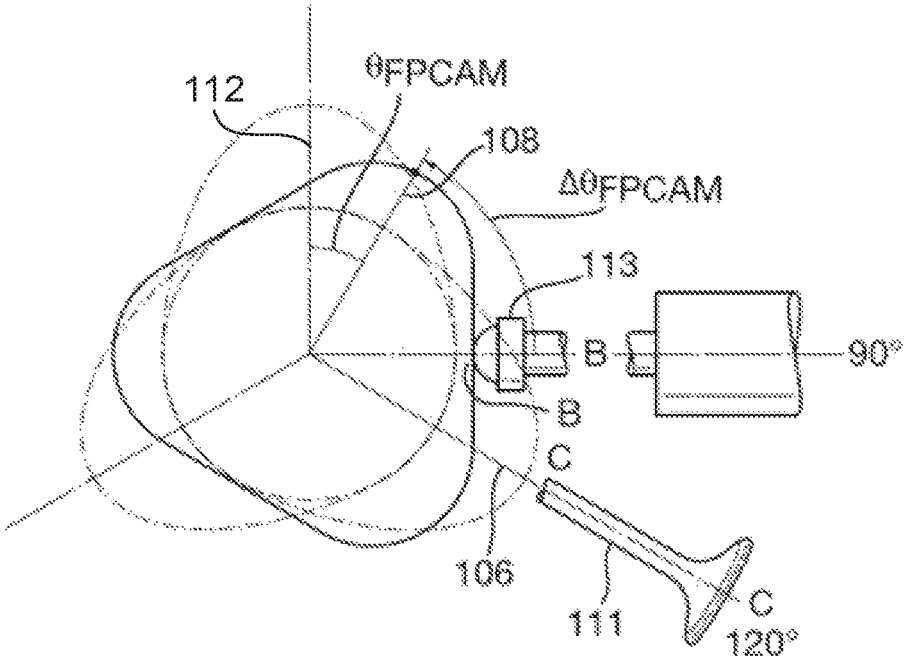
FIG. 4 shows an end view of a first arrangement of a camshaft and a fuel pump.

FIG. 4 shows a first arrangement of the camshaft 101 and the fuel pump drive element 113, in which the angular orientation $\theta_{FPCAM}$ of the fuel pump cam 107 with respect to the angular orientation $\theta_{VCAM_a}$, $\theta_{VCAM_b}$, $\theta_{VCAM_c}$ of the pairs of valve cams 105*a*, 105*b*, 105*c* has been rotationally offset by an angle $\Delta\theta_{FPCAM}$. Such a rotational offset may be achieved by re-orientating the fuel pump cam 107 relative to the valve cams 105. In one arrangement, the cams 105, 107 of the camshaft may be rigidly fixed to the camshaft 101, and an existing camshaft may be replaced by a modified camshaft having the configuration shown in FIG. 4. In another arrangement, the cams 105, 107 of the camshaft may be moveably coupled to the camshaft 101, and engine may comprise a system configured to adjust the rotational orientation of the cams 105, 107 relative to one another.

In the arrangement shown in FIG. 4, the fuel pump cam 107 has been rotated anticlockwise by the angle $\Delta\theta_{FPCAM}$, which is equal to half the angle between the lobe centrelines 106 of the first valve cam pair 105*a* and the second first valve cam pair 105*b*, i.e. $\Delta\theta_{FPCAM}=120/2=60°$. The angle $\Delta\theta_{FPCAM}$ may, however, be any appropriate angle, depending on the configuration of the valve cams 105 and the fuel pump cam 107.

Figure 5:
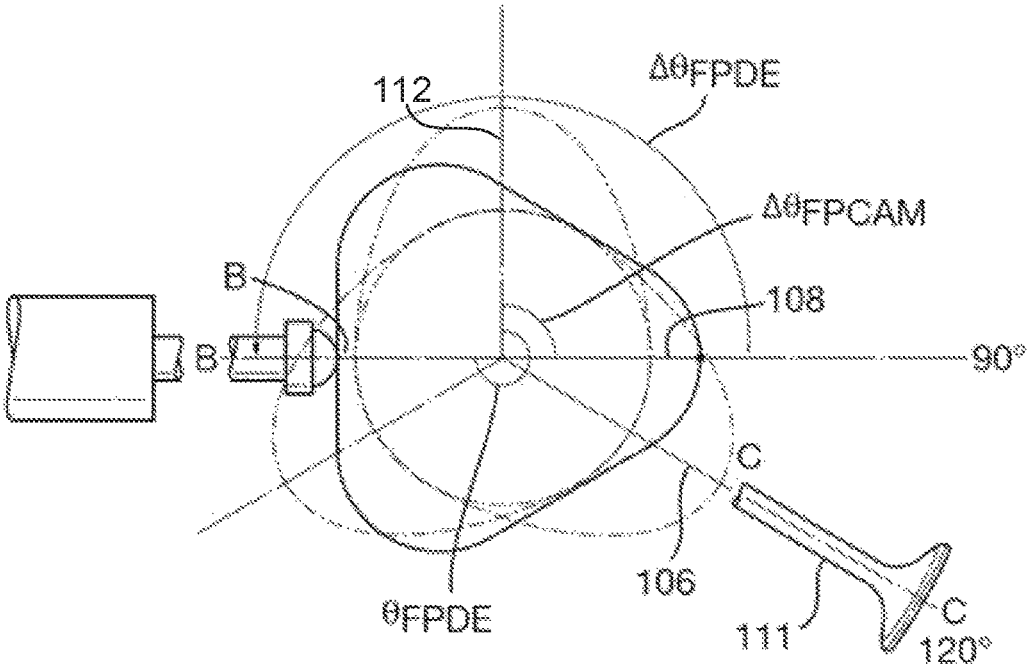
FIG. 5 shows an end view of a second arrangement of a camshaft and a fuel pump.

FIG. 5 shows a second arrangement of the camshaft 101 and the fuel pump drive element 113, in which the angular orientation $\theta_{FPDE}$ of the operational axis B-B of the fuel pump drive element 113 with respect to the angular orientation $\theta_{VCAM_a}$, $\theta_{VCAM_b}$, $\theta_{VCAM_c}$ of the pairs of valve cams 105*a*, 105*b*, 105*c* has been rotationally offset by an angle $\Delta\theta_{FPDE}$. Such a rotational offset may be achieved by re-orientating the fuel pump drive element 113, and/or the fuel pump 109, about the rotational axis A-A of the cam shaft 101. For example, the points at which the fuel pump 109 attaches to the engine may be selected to reorientate the operational axis B-B of the fuel pump drive element 113 relative to a centreline 108 of a lobe of the fuel pump cam 107 when the fuel pump 109 is at peak displacement. Additionally or alternatively, one or more linking mechanisms may be used to alter the orientation of the operational axis B-B of the fuel pump drive element 113 relative to a centreline 108 of a lobe of the fuel pump cam 107 when the fuel pump 109 is at peak displacement.

In the arrangement shown in FIG. 5, the angle $\Delta\theta_{FPDE}$ is equal to 180° relative to a vertical 112 owing to the configuration of the fuel pump cam 107. For example, since the fuel pump cam 107 has three equally profiled lobes which are equi-angularly spaced around the rotational axis A-A of the camshaft 101, the nose of each lobe of the fuel pump cam 107 is diametrically opposite the minimum radius of the profile of the fuel pump cam 107. In another arrangement, however, the angle $\Delta\theta_{FPDE}$ may be any appropriate angle depending on the configuration of the valve cams 105 and the fuel pump cam 107.

Figure 6:
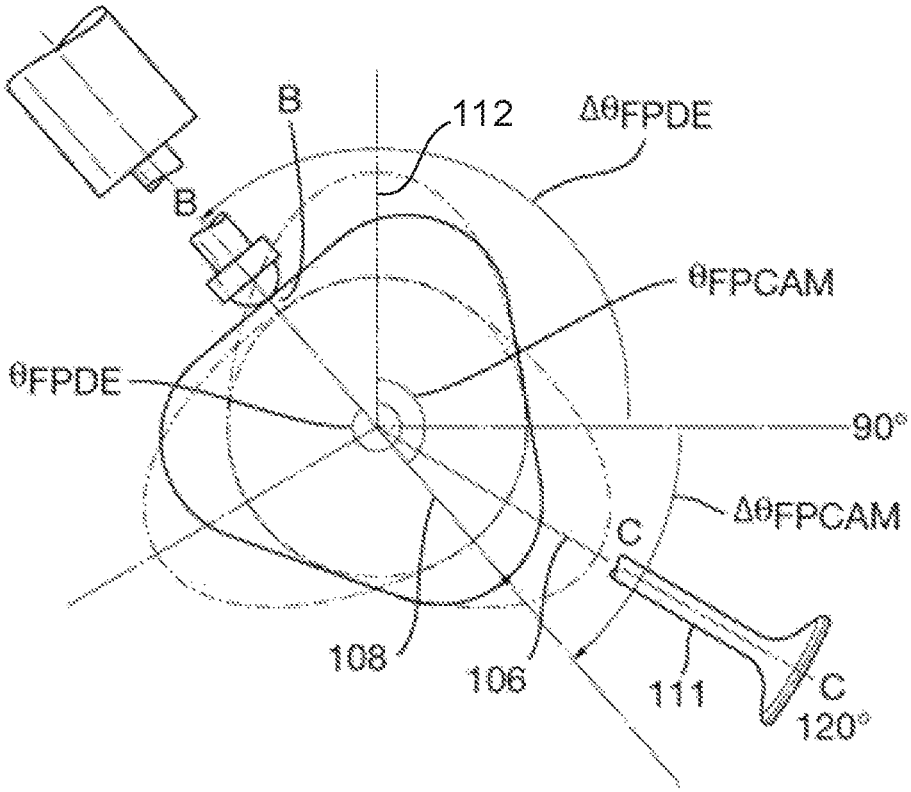
FIG. 6 shows an end view of a third arrangement of a camshaft and a fuel pump.

FIG. 6 shows a third arrangement of the camshaft 101 and the fuel pump drive element 113, in which the angular orientation $\theta_{FPCAM}$ of the fuel pump cam 107 and the angular orientation $\theta_{FPDE}$ of the operational axis B-B of the fuel pump drive element 113 with respect to the angular orientation $\theta_{VCAM_a}$, $\theta_{VCAM_b}$, $\theta_{VCAM_c}$ of the pairs of valve cams 105*a*, 105*b*, 105*c* have been offset by an angle $\Delta\theta_{FPCAM}$ and an angle $\Delta\theta_{FPDE}$ respectively. In the arrangement shown in FIG. 6, the fuel pump cam 107 has been rotated clockwise by an angle $\Delta\theta_{FPCAM}$ and the operational axis B-B of the fuel pump drive element 113 has been rotated anticlockwise by an angle $\Delta\theta_{FPDE}$.

Each of the arrangements shown in FIGS. 4, 5 and 6 illustrate a maximum possible phase angle offset $\Delta\theta_{PHASE}$ caused by angularly re-orientating the fuel pump cam 107 and/or the fuel pump drive element 113 about the rotational axis of the camshaft 101. As a result, the amplitude $A_{V+FP}$ of the oscillation of the resistive torque is minimised. In the arrangements shown in FIGS. 4, 5 and 6, the fuel pump cam 107 is orientated such that a lobe centreline 108 of the fuel pump cam 107 is inclined to the operational axis C-C of the valve 111, the fuel pump 109 is diametrically opposite the nose of a fuel pump cam lobe, and the operational axis B-B of the fuel pump drive element 113 is in line with a lobe centreline 108 of the fuel pump cam 107, when a lobe centreline 106 of a valve cam is in line with the operational axis C-C of the valve 111.

Figure 7:
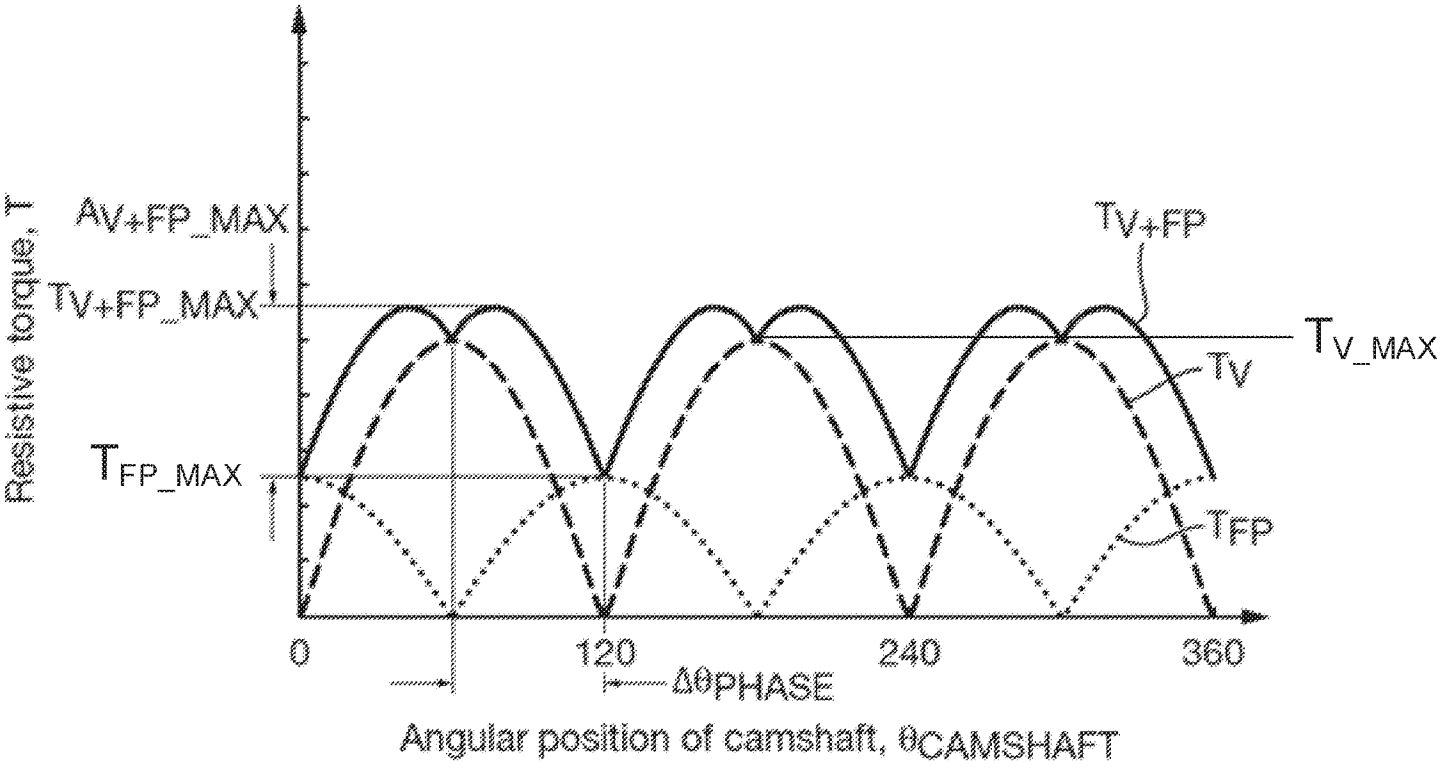
FIG. 7 shows a graphical representation of the relationship between the angular orientation of the camshaft and the resistive torques applied to the camshaft for the arrangements shown in FIGS. 4 to 6.

In this manner, as shown in FIG. 7, the angular orientation $\theta_{FPCAM}$ of the fuel pump cam 107 and/or the angular orientation $\theta_{FPDE}$ of the fuel pump drive element 113 with respect to the angular orientation $\theta_{VCAM_a}$, $\theta_{VCAM_b}$, $\theta_{VCAM_c}$ of the pairs of valve cams 105*a*, 105*b*, 105*c* may be selected such that the peak value $T_{FP_MAX}$ of the second period resistive torque occurs in between two successive peak values $T_{V_MAX}$ of the first periodic resistive torque $T_{FP}$.

In other words, the fuel pump cam 107 and/or the fuel pump drive element 113 may be re-orientated about the rotational axis A-A of the camshaft 101 such that the peak displacement of the fuel pump 109 occurs out of phase with the peak displacement of the valve 111.

FIG. 7 shows a shows a graphical representation of the first and second resistive torques $T_V$, $T_{FP}$ applied to the camshaft 101 with respect to the angular position of the camshaft $\theta_{CAMSHAFT}$ for the arrangements shown in FIGS. 4, 5 and 6. In FIG. 7, the angular re-orientation of the fuel pump cam 107 and/or the fuel pump 109 about the rotational axis of the camshaft 101 results in a phase angle offset $\Delta\theta_{PHASE}$. As a result the amplitude $A_{V+FP}$ of the oscillation of the resistive torque $T_{V+FP}$ is reduced.

However, in one or more other arrangements, the angular orientation the fuel pump cam 107 and/or the fuel pump drive element 113 about the rotational axis of the camshaft 101 may be selected to reduce amplitude $A_{V+FP}$ to a value in between a maximum possible amplitude shown in FIG. 3 and a minimum possible amplitude shown in FIG. 7. For example, the angular orientation $\theta_{FPCAM}$ of the fuel pump cam 107 and/or the angular orientation $\theta_{FPDE}$ of the operational axis B-B of the fuel pump drive element 113 with respect to the angular orientation $\theta_{VCAM_a}$, $\theta_{VCAM_b}$, $\theta_{VCAM_c}$ of the pairs of valve cams 105*a*, 105*b*, 105*c* may be selected such that each fuel pump actuation event, i.e. peak displacement of the fuel pump 109, occurs at a different time to a valve actuation event, i.e. peak displacement of the valve 111. The angle $\Delta\theta_{FPCAM}$ by which the fuel pump cam 107 is rotated and/or the angle $\Delta\theta_{FPDE}$ by which the operational axis B-B of the fuel pump drive element 113 is rotated may be any appropriate angle to give a non-zero phase angle offset $\Delta\theta_{PHASE}$, thereby reducing the difference between the maxima $T_{V+FP_MAX}$ and the minima $T_{V+FP_MIN}$ of the oscillation in the resistive torque $T_{V+FP}$. In some embodiments, the angular orientation $\theta_{FPDE}$ of the operational axis B-B of the fuel pump drive element 113 with respect to the angular orientation $\theta_{VCAM_a}$, $\theta_{VCAM_b}$, $\theta_{VCAM_c}$ of the pairs of valve cams may be selected such that the peak value $T_{FP_MAX}$ of the second periodic resistive torque occurs during a period of minimum resistive torque applied to the rotation of the camshaft via the valve cams and between the two successive peak values $T_{V_MAX}$ of the first periodic resistive torque.

Adjusting the timing of the fuel pump actuation events to occur between two successive valve actuation events may have the advantage of addressing the problem of torque fluctuations at the camshaft without compromising the valve lift. Further, adjusting the timing of the fuel pump actuation via selecting the angular orientation of the drive element of the auxiliary device with respect to the angular orientation of the valve cams is advantageous, as these adjustments to timing are made without altering the configuration of the camshaft.

Figure 8:
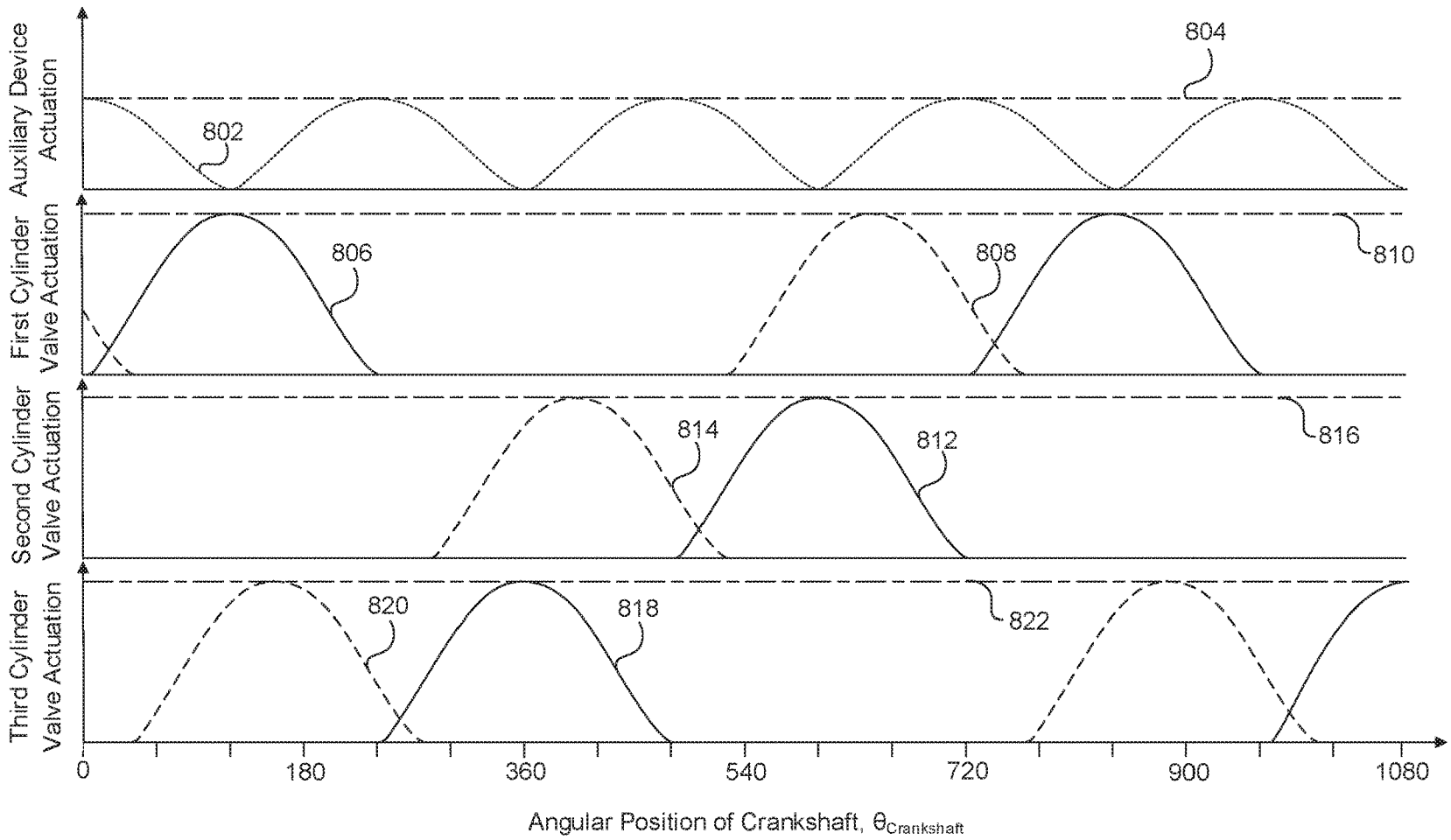
FIG. 8 shows a graphical representation of an example relationship between an angular orientation of the crankshaft of the engine and actuation events of the intake valves, the exhaust valves, and the auxiliary device for the arrangements, according to the present disclosure.

Turning now to FIG. 8, a graphical representation of an example relationship between an angular orientation of the crankshaft and actuation events of the intake valves, the exhaust valves, and the auxiliary device is shown. This graphical representation is drawn to scale, although other relative timings and amounts maybe used. This graphical representation may correspond to the arrangements shown in FIG. 1 and FIGS. 4 to 6. In this example, the relationship between the angular orientation of the crankshaft and the actuation events of the intake valves, the exhaust valves, and the auxiliary device is shown for arrangements where an auxiliary device cam is arranged on the intake camshaft. However, in other embodiments the auxiliary device cam may be arranged on an exhaust camshaft. In one example, the auxiliary device is a fuel pump. Actuation of the auxiliary device may include actuation of a drive element of the auxiliary device via an auxiliary device cam, as described above. Actuation of the intake valves and the exhaust valves may be accomplished via valve cams, as described above. The X axis of the graphical representation represents an angular position of the crankshaft of the engine, $\theta_{Crankshaft}$. For every 360° of rotation of the crankshaft, the intake camshaft and the exhaust camshaft are rotated 180°. As such, the relationship between the crankshaft degrees of rotation to the intake camshaft and the exhaust camshaft degrees of rotation is 2:1. The Y axis of the top plot represents the displacement of the auxiliary device, where the amount of displacement of the auxiliary device increases in the direction of the Y axis arrow. The auxiliary device is fully actuated at a maximum displacement of the auxiliary device. The Y axes for the remaining plots represent the amount of displacement of the intake valves and the exhaust valves, where the amount of displacement of the valves increases in the direction of the arrows of these Y axes. The intake valves and exhaust valves are fully actuated at their maximum displacements.

In this example, the graphical representation corresponds to an in-line 3 cylinder engine with a 1, 3, 2 cylinder firing order. In other examples, the in-line 3 cylinder engine may have a 1, 2, 3 cylinder firing order.

The top plot represents the actuation events of the auxiliary device. The amount of displacement of the auxiliary device is indicated with dotted line 802. The auxiliary device is fully actuated at line 804, where a maximum displacement of the auxiliary device occurs.

The plot second from the top represents the first cylinder valve actuation events. The displacement of the intake valves is represented with solid line 806. The displacement of the exhaust valves is indicated with dashed line 808. The valves of the first cylinder are fully actuated at line 810, where a maximum displacement of the valves occurs.

The plot third from the top represents the second cylinder valve actuation events. The displacement of the intake valves is represented with solid line 812. The displacement of the exhaust valves is represented with dashed line 814. The valves of the second cylinder are fully actuated at line 816, where a maximum displacement of the valves occurs.

The plot fourth from the top represents the third cylinder valve actuation events. The displacement of the intake valves is represented with solid line 818. The displacement of the exhaust valves is represented with dashed line 820. The valves of the third cylinder are fully actuated at line 822, where a maximum displacement of the valves occurs.

The intake valves are actuated via valve cams on the intake camshaft and the auxiliary device is actuated via an auxiliary device cam. FIG. 8 is a graphical representation for an example system where the auxiliary device cam is arranged on the intake camshaft. Therefore, in FIG. 8, the amount of resistive torque applied to the intake camshaft increases as the intake valve and the auxiliary device displacements increase. As discussed earlier, the amount of resistive torque applied to a camshaft is additive. Therefore, in FIG. 8, the amount of resistive torque applied to the intake camshaft may be the sum of the resistive torque due to the actuation of the intake valves and the resistive due to actuation of the auxiliary device. Since the exhaust valves are actuated via valve cams arranged on the exhaust camshaft, the amount of resistive torque applied to the exhaust camshaft increases as the amount of exhaust valve displacement increases.

As shown in FIG. 8, when the $\theta_{Crankshaft}$ moves from 0° to 120°, the auxiliary device displacement 802 decreases from a maximum displacement amount 804 to a minimum displacement amount. Additionally, the first cylinder exhaust valve displacement decreases to a minimum displacement when $\theta_{Crankshaft}$ is about 60°, and the first cylinder intake valve displacement 806 increases from a minimum amount starting when the $\theta_{Crankshaft}$ is 0° to a maximum displacement amount 810 when $\theta_{Crankshaft}$ is 120°. Additionally, the second cylinder intake valve displacement 812 and exhaust valve displacement 814 remain at a minimum, and the third cylinder exhaust valve displacement 820 increases from a minimum when $\theta_{Crankshaft}$ is 0° to near a maximum displacement amount 822 when $\theta_{Crankshaft}$ is 120°.

When $\theta_{Crankshaft}$ is 120°, the auxiliary device displacement 802 is at its minimum amount of displacement, and the first cylinder intake valve displacement 806 is at its maximum displacement 810. Additionally, at the second cylinder when $\theta_{Crankshaft}$ is 120°, both the displacement of the intake valves 812 and the exhaust valves 814 are at a minimum amount of displacement. At the third cylinder, the exhaust valve displacement 820 is increasing and near its maximum amount of displacement 822 when $\theta_{Crankshaft}$ is 120°.

As such, when the $\theta_{Crankshaft}$ is at 120°, the intake camshaft experiences resistive torque due to the actuation of the intake valves of the first cylinder, and the intake camshaft experiences substantially zero to zero resistive torque from the auxiliary device, as the displacement of the auxiliary device is at a minimum. Additionally, when $\theta_{Crankshaft}$ is 120°, the exhaust camshaft experiences resistive torque due to displacement of the exhaust valve 820 of the third cylinder.

When the $\theta_{Crankshaft}$ moves from 120° to 240°, the auxiliary device displacement 802 increases from a minimum amount of displacement towards a maximum amount of displacement 804. The intake valve displacement of the first cylinder 806 decreases from a maximum displacement 810 towards a minimum amount of displacement from $\theta_{Crankshaft}$ of 120° to 240°. The intake valves and the exhaust valves of the second cylinder remain at a minimum amount of displacement from $\theta_{Crankshaft}$ of 120° to 240°. The third cylinder exhaust valve displacement 820 increases to a maximum amount of displacement 822 at about $\theta_{Crankshaft}$ of 150° and then decreases to a minimum amount of displacement at $\theta_{Crankshaft}$ of 240°.

When $\theta_{Crankshaft}$ is 240°, the auxiliary device displacement 802 is at a maximum displacement amount 804. Additionally, the first cylinder intake valve displacement 806 is at a minimum displacement. At the second cylinder, the intake valves and the exhaust valves are both at a minimum amount of displacement when $\theta_{Crankshaft}$ is equal to 240°. The third cylinder exhaust valve displacement 820 is decreasing towards a minimum displacement when $\theta_{Crankshaft}$ is equal to 240°, and the third cylinder intake valve displacement 818 is at a minimum and beginning to increase when $\theta_{Crankshaft}$ is equal to 240°.

Therefore, when $\theta_{Crankshaft}$ is equal to 240°, the intake camshaft experiences a minimal amount to zero resistive torque from the intake valves because the intake valves of the first, second, and third cylinders are all at minimum amounts of displacement. However, when $\theta_{Crankshaft}$ is equal to 240°, the intake camshaft experiences resistive torque due to the displacement of the auxiliary device. Increasing the displacement of the auxiliary device as the intake valves move towards a minimum amount of displacement has the advantage of reducing a fluctuation in resistive torque applied to the intake camshaft.

When the $\theta_{Crankshaft}$ moves from 240° to 360°, the auxiliary device displacement decreases from a maximum amount of displacement 804 to a minimum amount of displacement. The first cylinder intake and exhaust valves remain at a minimum amount of displacement when the $\theta_{Crankshaft}$ moves from 240° to 360°. The second cylinder exhaust valve displacement 814 increases from a minimum amount of displacement starting at about $\theta_{Crankshaft}$ of 280° and nears a maximum amount of displacement 810 when $\theta_{Crankshaft}$ is 360°. The third cylinder exhaust valve displacement 820 decreases to a minimum amount of displacement, and the third cylinder intake valve displacement 818 increases from a minimum amount of displacement and reaches a maximum amount of displacement 822 from a $\theta_{Crankshaft}$ of 240° to 360°.

When $\theta_{Crankshaft}$ is 360°, the auxiliary device displacement 802 is at a minimum amount of displacement. The first cylinder intake valve displacement 806 and exhaust valve displacement 808 are at a minimum displacement amount when $\theta_{Crankshaft}$ is equal to 360° $\theta_{Crankshaft}$ equal to 360°. The second cylinder exhaust displacement 814 is near a maximum amount of displacement 816 at the third cylinder intake valve displacement 818 is at a maximum amount of displacement 822 at $\theta_{Crankshaft}$ equal to 360°.

When the $\theta_{Crankshaft}$ moves from 360° to 480°, the auxiliary device displacement 802 increases from a minimum amount of displacement to a maximum amount of displacement 804. Additionally, the first cylinder intake valve displacement 806 and exhaust valve displacement 808 remain at a minimum amount of displacement from a $\theta_{Crankshaft}$ of 360° to 480°. The second cylinder exhaust valve displacement 814 increases to a maximum amount of displacement 816 at about $\theta_{Crankshaft}$ of 410°, and then begins to decrease. The third cylinder amount of intake valve displacement 360 decreases from a maximum amount of displacement 822 to a minimum amount of displacement from a $\theta_{Crankshaft}$ of 360° to 480°.

When the $\theta_{Crankshaft}$ is at 480°, the auxiliary device displacement 802 is at a maximum displacement 804, and all of the intake valves of the three cylinders are at a minimum displacement. Additionally, the second cylinder exhaust valve displacement 814 is near a minimum displacement.

When the $\theta_{Crankshaft}$ moves from 480° to 600°, the auxiliary device displacement 802 decreases to a minimum displacement, and the second cylinder intake valve displacement 812 increases from a minimum displacement to a maximum displacement 816. Additionally, the first cylinder exhaust valve displacement 808 increases, and the third cylinder valves remain at a minimum displacement.

When the $\theta_{Crankshaft}$ is at 600°, the auxiliary device is at a minimum displacement, and the second cylinder intake valve displacement 812 is at a maximum displacement 816. Additionally, the first cylinder exhaust valve displacement 808 is near a maximum displacement 810. The third cylinder intake and exhaust valve displacements are at a minimum displacement.

When the $\theta_{Crankshaft}$ moves from 600° to 720°, the auxiliary device displacement 802 moves from a minimum displacement to a maximum displacement 804, and the second cylinder intake valve displacement 812 decreases from a maximum displacement 816 to a minimum displacement. Additionally, the first cylinder exhaust valve displacement 808 increases to a maximum displacement 810 and then decreases, and the third cylinder intake valve and exhaust valve displacements remain at a minimum displacement.

When the $\theta_{Crankshaft}$ is at 720°, the auxiliary device displacement 802 is at a maximum displacement 804, and the second cylinder intake valve displacement 812 is at a minimum displacement. Additionally, the first cylinder exhaust valve displacement 808 is near a minimum displacement, and the third cylinder intake valve and exhaust valve displacements are at a minimum displacement.

When the $\theta_{Crankshaft}$ is at 720°, the crankshaft has completed two full rotations, and the intake camshaft and the exhaust camshaft have each completed one rotation. The two full rotations of the crankshaft concludes one full cycle of actuating the intake valves, exhaust valves, and the auxiliary device. Following 720° of crankshaft rotation, the actuation cycle repeats again, and the displacements of the intake valves, exhaust valves, and the auxiliary device relative to each other repeat.

As illustrated in FIG. 8, actuation of the auxiliary device occurs between two, successive, maximum displacements of the intake valves. In one example, the maximum displacement of the auxiliary device occurs between two successive, maximum displacements of the intake valves and when the intake valves are at a minimum displacement. This may be advantageous for minimizing torque fluctuations at the intake camshaft. In other embodiments, where the auxiliary cam is arranged on the exhaust camshaft, the auxiliary device may be actuated between two successive actuation events of the exhaust valves. In embodiments where the auxiliary cam is arranged on the exhaust camshaft, the torque fluctuations at the exhaust camshaft are reduced.

It will be appreciated by those skilled in the art that although the invention has been described by way of example with reference to one or more examples, it is not limited to the disclosed examples and that alternative examples could be constructed without departing from the scope of the invention as defined by the appended claims. It will further be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. As another example, the above technology can be applied to engines with variable valve timing and lift. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. An engine comprising a camshaft, the engine being coupleable to an auxiliary device that is driven from the camshaft, the camshaft comprising:

a plurality of valve cams, each valve cam configured to actuate a respective valve of the engine by displacing the respective valve, an angular orientation of the plurality of valve cams about a rotational axis of the camshaft being defined by operational requirements of the valves; and an auxiliary device cam configured to actuate a drive element of an auxiliary device by virtue of a plurality of auxiliary device cam lobes which displace the drive element, the auxiliary device cam having an angular orientation about the rotational axis of the camshaft, and the drive element having an angular orientation about the rotational axis of the camshaft when the auxiliary device is coupled to the engine, wherein the angular orientation of the drive element of the auxiliary device is selected with respect to the angular orientation of the valve cams such that each maximum displacement occurrence of the auxiliary device is concurrent with a minimum displacement of the valves, and where each maximum displacement occurrence of the auxiliary device is offset from all maximum displacement occurrences of the valves of the engine, and wherein a working axis of the drive element of the auxiliary device and a working axis of the engine valves are angularly oriented less than 45 degrees apart about the rotational axis of the camshaft.

2. The engine according to claim 1, wherein:

each valve cam provides a first periodic resistive torque to rotation of the camshaft as the valve cam actuates the engine valve; and the auxiliary device cam provides a second periodic resistive torque to the rotation of the camshaft as the auxiliary device cam actuates the auxiliary device, wherein a peak value of the second periodic resistive torque occurs in between two successive peak values of the first periodic resistive torque.

3. The engine according to claim 2, wherein the first and second periodic resistive torques define an oscillation in a resistive torque provided to a primary drive of the engine during operation of the engine, the angular orientation of the auxiliary device cam and/or an angular orientation of an operational axis of the auxiliary device with respect to the angular orientation of the valve cams being selected to reduce an amplitude of the oscillation in the resistive torque provided to the camshaft.

4. The engine according to claim 3, wherein the angular orientation of the auxiliary device cam and/or the angular orientation of the operational axis of the auxiliary device with respect to the angular orientation of the valve cams are selected to minimize a magnitude between a maxima and a minima of the oscillation in the resistive torque.

5. The engine according to claim 1, wherein the camshaft is configured such that an operational axis of the auxiliary device extends radially from the rotational axis of the camshaft when the camshaft and the auxiliary device are in an installed configuration.

6. The engine according to claim 1, wherein a shape of each lobe of the auxiliary device cam is independently selected to reduce an amplitude of an oscillation in resistive torque.

7. The engine according to claim 1, wherein the working axis of the drive element of the auxiliary device and the working axis of the engine valves are angularly oriented greater than 0 degrees apart about the rotational axis of the camshaft.

8. The engine according to claim 1, wherein the plurality of engine valve cams is equi-angularly spaced around the rotational axis of the camshaft.

9. The engine according to claim 1, wherein each of the valve cams and/or the auxiliary device cam is rigidly fixed to the camshaft.

10. The engine according to claim 1, wherein each of the valve cams and/or the auxiliary device cam is movable with respect to the camshaft.

11. The engine according to claim 1, wherein the auxiliary device is a fuel pump.

12. The engine according to claim 1, wherein the drive element of the auxiliary device has an operational axis that is inclined to, offset from, and/or remote from an operational axis of the auxiliary device.

13. The engine according to claim 1, wherein the auxiliary device comprises a linkage mechanism, the linkage mechanism being configured to operatively couple the auxiliary device to the auxiliary device drive element.

14. A method of manufacturing an engine comprising a camshaft, the engine being coupleable to an auxiliary device that is driven from the camshaft, the method comprising:

configuring each of a plurality of valve cams to actuate a respective intake valve or exhaust valve of the engine, an angular orientation of each of the plurality of valve cams about a rotational axis of the camshaft being defined by operational requirements of the respective intake valve or exhaust valve;

configuring an auxiliary device cam to actuate a drive element of the auxiliary device by virtue of one or more cam lobes, the auxiliary device cam having an angular orientation about the rotational axis of the camshaft, and the drive element having an angular orientation about the rotational axis of the camshaft when the auxiliary device is coupled to the engine; and selecting the angular orientation of the drive element of the auxiliary device with respect to the angular orientation of the valve cams such that each actuation event peak of the auxiliary device only occurs in between two successive valve actuation event peaks, and such that each actuation event peak of the auxiliary device is offset from all valve actuation event peaks of all cylinders of the engine, wherein a nose of each lobe of the plurality of valve cams is offset less than 45 degrees from a nose of an auxiliary device cam lobe, where the auxiliary device cam comprises a plurality of auxiliary device cam lobes, and wherein a working axis of the drive element of the auxiliary device and a working axis of the engine valves are angularly oriented less than 45 degrees apart about the rotational axis of the camshaft.

15. An engine comprising a camshaft, the engine coupleable to an auxiliary device driven from the camshaft, the camshaft comprising:

a plurality of valve cams that each actuate a respective engine valve; and an auxiliary device cam that actuates a drive element of the auxiliary device, an angular orientation of the drive element selected with respect to an angular orientation of the valve cams so that each actuation event peak of the auxiliary device occurs between two successive valve actuation event peaks, and so that each actuation event peak of the auxiliary device is between every two successive valve actuation event peaks of each cylinder of the engine, wherein a maximum amount of engine valve resistive torque is applied to the camshaft during each valve actuation event peak, wherein a maximum amount of auxiliary device resistive torque is applied to the camshaft during each actuation event peak of the auxiliary device, and wherein a nose of each lobe of the plurality of valve cams is offset less than 45 degrees from a nose of an auxiliary device cam lobe, where the auxiliary device cam comprises a plurality of auxiliary device cam lobes.

16. The engine according to claim 15, wherein all of the actuation event peaks of the auxiliary device occur between all of the valve actuation event peaks of all of the cylinders of the engine.

17. The engine according to claim 15, wherein the angular orientation of the drive element with respect to the angular orientation of the valve cams is further selected to actuate the auxiliary device when a minimum amount of resistive torque is applied to rotation of the camshaft via the valve cams.

18. The engine according to claim 15, where the nose of each lobe of the plurality of valve cams is offset greater than 0 degrees from each of the plurality of the auxiliary device cam lobes.

19. The engine according to claim 15, where the valves actuated by the valve cams include intake valves of the engine.

20. The engine according to claim 19, where the valves actuated by the valve cams include exhaust valves of the engine.

* * * * *